US007500467B2

(12) United States Patent
Hanamura

(10) Patent No.: US 7,500,467 B2
(45) Date of Patent: Mar. 10, 2009

(54) THROTTLE OPENING CONTROL SYSTEM AND METHOD FOR INTERNAL COMBUSTION ENGINE

(75) Inventor: Hiroyuki Hanamura, Gotenba (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/879,504

(22) Filed: Jul. 18, 2007

(65) Prior Publication Data

US 2008/0060614 A1 Mar. 13, 2008

(30) Foreign Application Priority Data

Sep. 12, 2006 (JP) ..... 2006-246987

(51) Int. Cl.
*F02D 11/10* (2006.01)
*F02D 11/00* (2006.01)

(52) U.S. Cl. ..... 123/399; 123/376

(58) Field of Classification Search ..... 123/399, 123/376, 492, 493; 477/905
See application file for complete search history.

(56) References Cited

U.S. PATENT DOCUMENTS 5,405,301 A * 4/1995 Yagi et al. ..... 477/120
6,236,929 B1 * 5/2001 Sen et al. ..... 701/93
7,052,434 B2 5/2006 Makino et al.
2001/0035159 A1 * 11/2001 Tsunooka ..... 123/399
2001/0039940 A1 * 11/2001 Kuretake ..... 123/399
2002/0134352 A1 * 9/2002 Kuretake ..... 123/399
2004/0112335 A1 * 6/2004 Makino et al. ..... 123/399
2006/0042592 A1 * 3/2006 Confer et al. ..... 123/399

FOREIGN PATENT DOCUMENTS

JP A 6-317195 11/1994
JP A 9-310637 12/1997
JP A 2004-124857 4/2004

* cited by examiner

*Primary Examiner*—Mahmoud Gimie
(74) *Attorney, Agent, or Firm*—Oliff & Berridge, PLC

(57) ABSTRACT

During a process of increasing the throttle opening when the accelerator pedal is depressed while the vehicle is in a decelerating condition, first throttle opening holding control for holding the throttle opening substantially constant is performed. During the process of increasing the throttle opening after the first throttle opening holding control is finished, second throttle opening holding control for holding the throttle opening substantially constant again is performed.

12 Claims, 5 Drawing Sheets

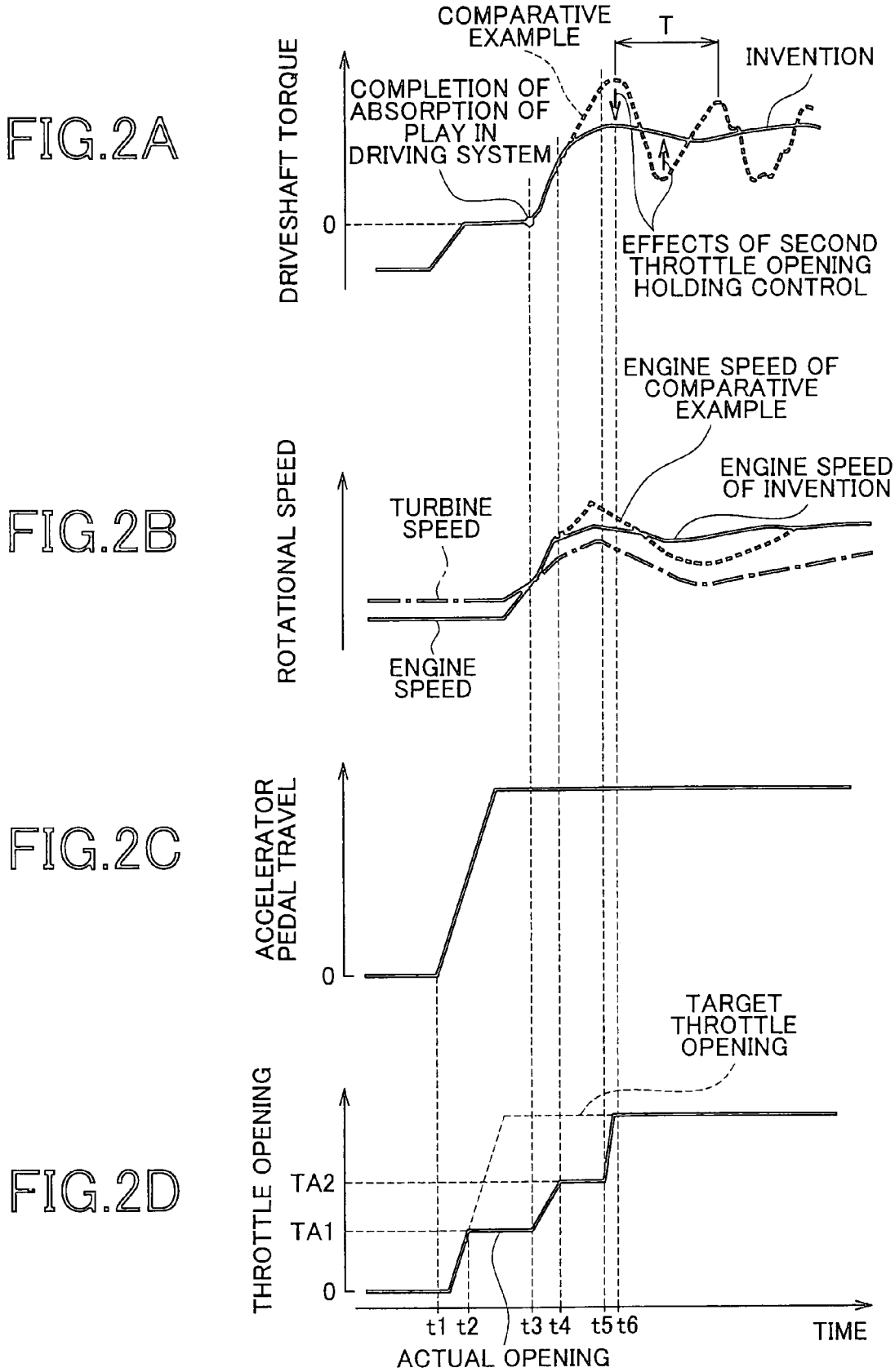
FIG.2A
DRIVESHAFT TORQUE
COMPARATIVE EXAMPLE
T
INVENTION
COMPLETION OF ABSORPTION OF PLAY IN DRIVING SYSTEM
0
EFFECTS OF SECOND THROTTLE OPENING HOLDING CONTROL
FIG.2B
ROTATIONAL SPEED
ENGINE SPEED OF COMPARATIVE EXAMPLE
ENGINE SPEED OF INVENTION
TURBINE SPEED
ENGINE SPEED
FIG.2C
ACCELERATOR PEDAL TRAVEL
0
FIG.2D
THROTTLE OPENING
TARGET THROTTLE OPENING
TA2
TA1
0
t1 t2 t3 t4 t5 t6
TIME
ACTUAL OPENING

THROTTLE OPENING CONTROL SYSTEM AND METHOD FOR INTERNAL COMBUSTION ENGINE

INCORPORATION BY REFERENCE

The disclosure of Japanese Patent Application No. 2006-246987 filed on Sep. 12, 2006, including the specification, drawings and abstract, is incorporated herein by reference in its entirety.

BACKGROUND OF THE INVENTION

1. Field of the Invention

The invention relates to throttle opening control system and method for an internal combustion engine.

2. Description of Related Art

In internal combustion engines of motor vehicles, electronically controlled throttle valves are widely used. The electronically controlled throttle valve is driven, i.e., opened and closed, by an actuator. Thus, the degree of opening of the throttle valve (which will be called "throttle opening") can be controlled with a high degree of flexibility or freedom, irrespective of the amount of depression of the accelerator pedal.

Generally, play or looseness exists in a driving system including, for example, a transmission and a differential gear unit. When the accelerator pedal is depressed while the vehicle is in a decelerating condition (with the accelerator pedal released), and the vehicle starts being accelerated, the direction of torque transmitted between the engine and the driving system is reversed. Upon the torque reversal, the play in the driving system is absorbed or removed. Accordingly, if the rate of increase of the engine speed at the time of the torque reversal is high, shock arising upon absorption of play in the driving system (which will be called "driving-system play-derived shock") is transmitted to the vehicle, and is likely to be felt by the vehicle driver or operator.

In this case, if the rate of increase of the throttle opening in response to depression of the accelerator pedal is reduced, the rate of increase of the engine speed is also reduced, and acceleration shock may be suppressed. However, if the rate of increase of the throttle opening is simply reduced, the response to depression of the accelerator pedal may deteriorate (or become slow), thus causing deterioration of the drivability.

For example, JP-A-2004-124857 discloses a throttle opening control system that reduces the rate of increase of the throttle opening at the time when the direction of torque transmitted between the engine and the driving system is reversed, so as to suppress the above-mentioned driving-system play-derived shock. With this system, the rate of increase of the engine speed at the time of torque reversal can be reduced, thereby to suppress the driving-system play-derived shock while preventing deterioration of the response.

When the accelerator pedal is depressed while the vehicle is in a decelerating condition, acceleration shock may occur due to sway-back of the driving system transmitted to the vehicle, in addition to the above-mentioned driving-system play-derived shock. When the engine develops torque in response to opening of the throttle valve, and the engine torque is transmitted to the driving system, the driving system is placed in a twisted condition for a moment. Reaction force generated from the driving system when it is restored from the twisted condition causes sway-back of the driving system.

In the throttle opening control system- as disclosed in the above-identified publication, acceleration shock due to sway-back of the driving system is not taken into consideration, and there may arise a problem that the acceleration shock due to sway-back of the driving system cannot be sufficiently suppressed.

SUMMARY OF THE INVENTION

It is an object of the invention to provide a throttle opening control system for an internal combustion engine, which achieves both quick response and suppression of acceleration shock when the accelerator pedal is depressed while the vehicle is in a decelerating condition.

A first aspect of the invention is concerned with a throttle opening control system for an internal combustion engine that is installed on a vehicle and drives the vehicle via a driving system. The throttle opening control system includes first throttle opening holding means for performing first throttle opening holding control for temporarily holding the throttle opening substantially constant during a process of increasing the throttle opening when an accelerator pedal is depressed while the vehicle is in a decelerating condition, and second throttle opening holding means for performing second throttle opening holding control for temporarily holding the throttle opening substantially constant again during the process of increasing the throttle opening, after the first throttle opening holding control is finished.

The throttle opening control system for the internal combustion engine according to the above-indicated first aspect of the invention performs first throttle opening holding control for temporarily holding the throttle opening substantially constant during a process of increasing the throttle opening when the accelerator pedal is depressed while the vehicle is in a decelerating condition, and performs second throttle opening holding control for temporarily holding the throttle opening substantially constant again during the process of increasing the throttle opening, after the first throttle opening holding control is finished. This throttle opening control system for the internal combustion engine is able to effectively suppress shock derived from play in the driving system through the first throttle opening holding control, and is also able to effectively suppress sway-back of the driving system through the second throttle opening holding control. It is also possible to increase the throttle opening at a relatively high rate when the first and second throttle opening holding controls are not performed, while sufficiently suppressing shock derived from play in the driving system and sway-back of the driving system. Thus, the control system achieves high levels of suppression of acceleration shock and quick response when the vehicle is accelerated from a decelerating condition.

In the throttle opening control system for the internal combustion engine, the first throttle opening holding control may be started while an engine speed is lower than an input shaft speed of the driving system, and the second throttle opening holding control may be started after the engine speed becomes equal to or higher than the input shaft speed.

In the throttle opening control system for the internal combustion engine, the first throttle opening holding control can be started while the engine speed is lower than the input shaft speed of the driving system, and the second throttle opening holding control can be started after the engine speed becomes equal to or higher than the input shaft speed. Since the first and second throttle opening holding controls can be respectively started at appropriate times, shock arising from play in the driving system and sway-back of the driving system can be further suppressed or reduced to smaller levels.

The throttle opening control system for the internal combustion engine may further include holding time control means for setting a throttle opening holding time for which the throttle opening is held substantially constant under the second throttle opening holding control, in accordance with a resonance frequency of torsional vibration of the driving system.

The throttle opening control system for the internal combustion engine can set the throttle opening holding time for which the throttle opening is held substantially constant under the second throttle opening holding control, in accordance with the resonance frequency of torsional vibration of the driving system. In this manner, variations in the driveshaft torque due to sway-back of the driving system can be further reduced or suppressed.

In the throttle opening control system for the internal combustion engine, the driving system may include a transmission having a plurality of gear positions or speed ratios, and holding time control means may be further provided for setting a throttle opening holding time for which the throttle opening is held substantially constant under the second throttle opening holding control, such that the throttle opening holding time becomes shorter as the transmission is in a higher-speed gear position or speed ratio.

The throttle opening control system for the internal combustion engine can set the throttle opening holding time for which the throttle opening is held substantially constant under the second throttle opening holding control, such that the throttle opening holding time becomes shorter as the transmission is in a higher-speed gear position or speed ratio. As the transmission is in a higher-speed gear position or establishes a smaller speed ratio, the resonance frequency of torsional vibration of the driving system becomes higher, and the resonance period becomes shorter. Since the throttle opening holding time for the second throttle opening holding control can be controlled in view of this fact, sway-back of the driving system can be further suppressed to a smaller level.

In the throttle opening control system for the internal combustion engine, the second throttle opening holding control may be finished before appearance of the first peak value of driveshaft torque variations caused by sway-back of the driving system.

In the throttle opening control system for the internal combustion engine, the second throttle opening holding control can be finished before appearance of the first peak value of driveshaft torque variations caused by sway-back of the driving system. In this manner, the timing of increase of the engine torque due to increase of the throttle opening after finishing of the second throttle opening holding control can be surely matched with the timing of appearance of the first trough of the driveshaft torque variations due to sway-back of the driving system. It is thus possible to suppress or prevent dropping of the driveshaft torque at the first trough of the driveshaft torque variations with higher reliability. Consequently, acceleration shock due to sway-back of the driving system can be reduced to a smaller level.

In the throttle opening control system for the internal combustion engine, the driving system may include a transmission having a plurality of gear positions or speed ratios, and specified opening setting means may be further provided for setting a specified throttle opening at which the throttle opening is substantially held under the second throttle opening holding control, based on an established gear position or speed ratio of the transmission and an engine speed.

In the throttle opening control system for the internal combustion engine, the specified throttle opening at which the throttle opening is substantially held under the second throttle opening holding control can be based on the established gear position or speed ratio of the transmission and the engine speed. Since the specified throttle opening for use in the second throttle opening holding control can be set to an optimum value for the established gear position or speed ratio and the engine speed, the control system achieves higher levels of suppression of sway-back of the driving system and quick response.

In the throttle opening control system for the internal combustion engine, the driving system may include a transmission having a plurality of gear positions or speed ratios, and opening rate-of-increase setting means may be further provided for setting a rate of increase of the throttle opening after finishing of the second throttle opening holding control, based on an established gear position or speed ratio of the transmission.

In the throttle opening control system for the internal combustion engine, the rate of increase of the throttle opening after finishing of the second throttle opening holding control can be based on the established gear position or speed ratio of the transmission. Since the rate of increase of the throttle opening after finishing of the second throttle opening holding control can be set to an optimum value for the established gear position or speed ratio, the control system achieves higher levels of suppression of sway-back of the driving system and quick response.

In the throttle opening control system for the internal combustion engine, the driving system may include a transmission having a plurality of gear positions or speed ratios, and means for setting at least one of a specified throttle opening at which the throttle opening is substantially held under the first throttle opening holding control, a throttle opening holding time for which the throttle opening is held substantially constant under the first throttle opening holding control, and a rate of increase of the throttle opening during a period between the first throttle opening holding control and the second throttle opening holding control, based on at least one of an established gear position or speed ratio of the transmission and an engine speed may be further provided.

In the throttle opening control system for the internal combustion engine, at least one of the specified throttle opening at which the throttle opening is substantially held under the first throttle opening holding control, the throttle opening holding time for which the throttle opening is held substantially constant under the first throttle opening holding control, and the rate of increase of the throttle opening during a period between the first throttle opening holding control and the second throttle opening holding control can be set based on at least one of the established gear position or speed ratio of the transmission and the engine speed. Since the throttle opening can be more appropriately controlled in accordance with the established gear position or speed ratio and/or the engine speed, the control system achieves even higher levels of suppression of acceleration shock and quick response.

In the throttle opening control system for the internal combustion engine, the driving system may include a transmission having a plurality of gear positions or speed ratios, and rotational-speed difference detecting means for detecting a rotational-speed difference between an engine speed and an input shaft speed of the driving system, and holding time setting means for setting a throttle opening holding time for which the throttle opening is held substantially constant under the first throttle opening holding control, based on an established gear position or speed ratio of the transmission, may be further provided. In this control system, the first throttle opening holding control is finished under an earlier satisfied one of a first condition that the rotational-speed difference becomes equal to zero and a second condition that the throttle opening holding time set by the holding time setting device expires.

In the throttle opening control system for the internal combustion engine, the first throttle opening holding control can be finished under an earlier satisfied one of the condition that a rotational-speed difference between the engine speed and the input shaft speed of the driving system becomes equal to zero and the condition that the throttle opening holding time set based on the gear position or speed ratio of the transmission expires. Thus, the control system achieves both suppression of shock derived from play in the driving system and quick response with higher reliability.

The throttle opening control system for the internal combustion engine may further include correcting means for correcting at least one of a first specified throttle opening at which the throttle opening is substantially held under the first throttle opening holding control, a throttle opening holding time for which the throttle opening is held substantially constant under the first throttle opening holding control, a rate of increase of the throttle opening during a period between the first throttle opening holding control and the second throttle opening holding control, a second specified throttle opening at which the throttle opening is substantially held under the second throttle opening holding control, and a rate of increase of the throttle opening after finishing of the second throttle opening holding control, based on an accelerator operation amount.

In the throttle opening control system for the internal combustion engine, at least one of the first specified throttle opening at which the throttle opening is substantially held under the first throttle opening holding control, the throttle opening holding time for which the throttle opening is held substantially constant under the first throttle opening holding control, the rate of increase of the throttle opening during a period between the first throttle opening holding control and the second throttle opening holding control, the second specified throttle opening at which the throttle opening is substantially held under the second throttle opening holding control, and the rate of increase of the throttle opening after finishing of the second throttle opening holding control can be corrected based on the accelerator operation amount, i.e., the amount of depression of the accelerator pedal. In this manner, the throttle opening can be corrected in accordance with a driver's demand as represented by the accelerator operation amount, so that the more important one of quick response and suppression of acceleration shock can be further improved. Consequently, the drivability can be further improved.

The throttle opening control system for the internal combustion engine may further include throttle opening reducing means for temporarily reducing the throttle opening after finishing of the first throttle opening holding control.

A second aspect of the invention is concerned with a method of controlling a throttle opening of an internal combustion engine that is installed on a vehicle and drives the vehicle via a driving system. The method includes a first step of temporarily holding the throttle opening substantially constant during a process of increasing the throttle opening when an accelerator pedal is depressed while the vehicle is in a decelerating condition, and a second step of temporarily holding the throttle opening substantially constant again during the process of increasing the throttle opening, after the first step is finished.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein:

FIG. 2A through FIG. 2D are timing charts useful for explaining throttle opening control of the first embodiment;

DETAILED DESCRIPTION OF EMBODIMENTS

Figure 1:
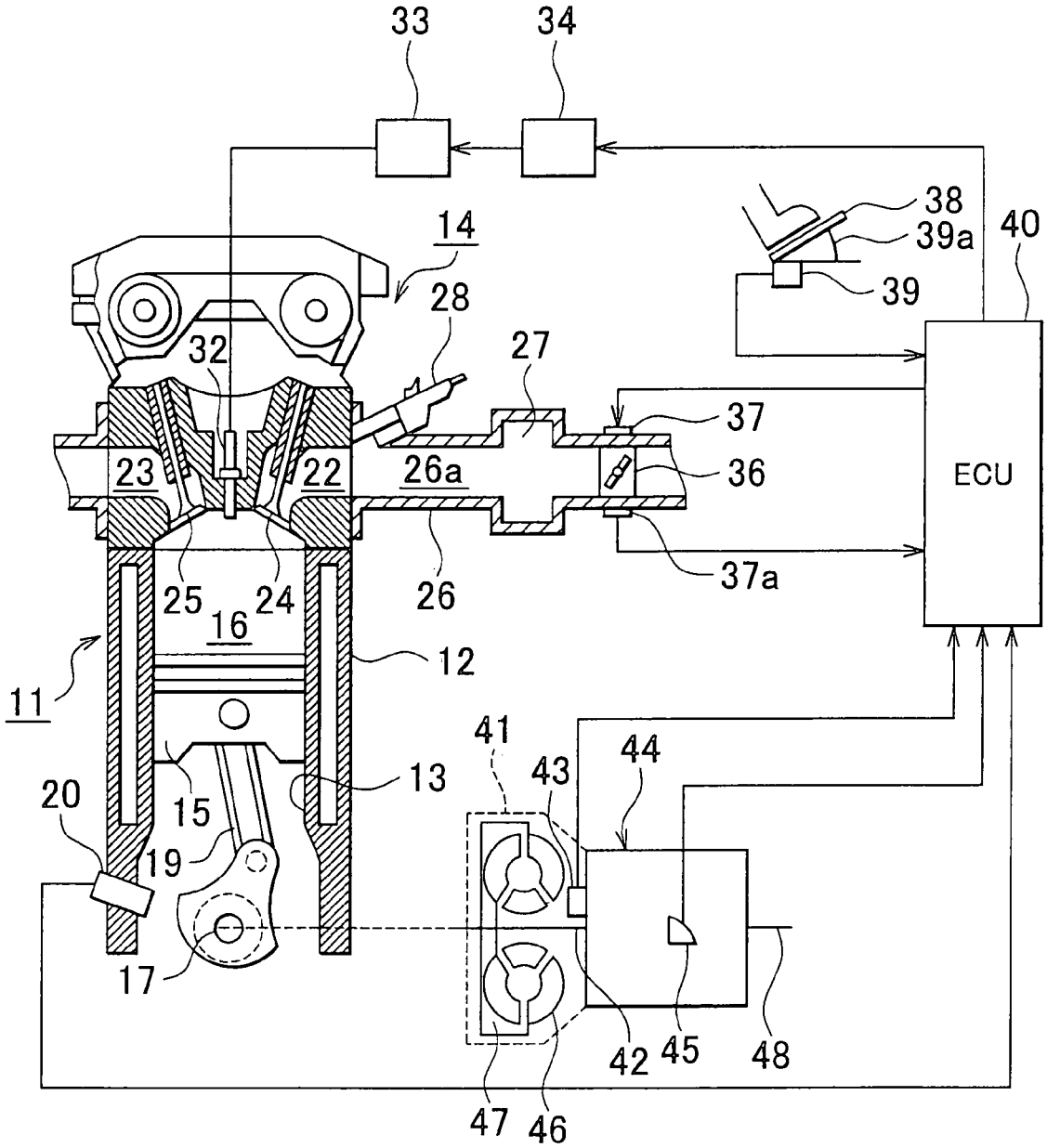
FIG. 1 is a view useful for explaining the construction of a system according to a first embodiment of the invention.

FIG. 1 is a view useful for explaining the construction of a system according to a first embodiment of the invention. An engine 11 shown in FIG. 1, which serves as a power source, is installed on a vehicle that is not illustrated. Cylinders 13 are formed in a cylinder block 12 of the engine 11, and a piston 15 is received in each of the cylinders 13 such that the piston 15 can reciprocate in the cylinder 13. Each of the cylinders 13 cooperates with the cylinder head 14 and the top face of the corresponding piston 15 to define a combustion chamber 16 in the engine 11. The engine 11 also includes a crankshaft 17 serving as an output shaft, and connecting rods 19 for converting reciprocating motion of the pistons 15 to rotary motion of the crankshaft 17.

An engine speed sensor 20 for detecting the rotational speed of the crankshaft 17 (which will be called "engine speed NE") is placed in the vicinity of the crankshaft 17.

In the meantime, intake port 22 and exhaust port 23 which communicate with the combustion chamber 16 are provided in the cylinder head 14. Intake valve 24 and exhaust valve 25 are mounted in the intake port 22 and exhaust port 23, respectively. An intake manifold 26, which provides an intake passage 26*a*, is connected to the intake port 22, and is provided with a surge tank 27. An injector 28 for injecting fuel into the intake port 22 is mounted in an end portion of the intake manifold 26 close to the cylinder head 14, so that a mixture of air and fuel can be supplied to the combustion chamber 16 through the intake port 22.

An electronically controlled throttle valve (hereinafter simply called "throttle valve") 36 for adjusting the amount of intake air supplied to the combustion chamber 16 is provided in the intake passage 26*a* upstream of the surge tank 27. A throttle valve motor 37 is provided for opening and closing the throttle valve 36 in a controlled manner. Driving of the throttle valve motor 37 is electrically controlled in accordance with a signal from an ECU 40 which will be described later. A throttle sensor 37*a* is provided for monitoring the degree of opening of the throttle valve 36 (which will be called "throttle opening"), and sending the sensed results to the ECU 40.

An ignition plug 32, which is provided for each of the cylinders of the engine 11, is electrically connected to an ignition coil 33 and an igniter 34. The igniter 34 passes electric current through a primary coil of the ignition coil 33 and stops the passage of current based on an ignition signal from the ECU 40, so that the ignition coil 33 causes sparking to occur in the ignition plug 32 using a high voltage induced at a secondary coil when the current to the primary coil is interrupted or stopped. Namely, the ignition plug 32 performs ignition in response to an ignition signal transmitted from the ECU 40 to the igniter 34.

In operation, outside air introduced via an air cleaner is drawn into the engine 11 through the intake manifold 26. Upon introduction of the outside air, fuel is injected from each of the injectors 28, so that a mixture of the outside air and fuel is fed to the corresponding combustion chamber 16 in synchronization with opening of the intake valve 24 on an intake stroke. The ignition plug 32 is then actuated to ignite the air-fuel mixture fed to the combustion chamber 16, so that the mixture explodes and burns to thus produce driving power for the engine 11. After explosion and combustion, exhaust gas is fed to an exhaust pipe in synchronization with opening of the exhaust valve 25 on an exhaust stroke, and is discharged from the exhaust pipe to the outside of the vehicle.

It is to be understood that the engine 11 is not limited to that of port injection type as shown in FIG. 1, but may be of in-cylinder or direct injection type in which fuel is directly injected from an injector mounted in each cylinder into the combustion chamber 16.

An acceleration stroke sensor 39 for detecting the amount of depression of the accelerator pedal 38 (which will be called "accelerator operation amount") is provided in the vicinity of the accelerator pedal 38.

An automatic transmission 44 including a torque converter 41 is coupled to the engine 11. More specifically, the crankshaft 17 of the engine 11 is coupled to a pump impeller 46 of the torque converter 41, such that the two members 17, 41 rotate as a unit. A turbine runner 47 of the torque converter 41 is coupled to an input shaft 42 that leads to a gearbox (or change gear mechanism) of the automatic transmission 44, such that the two members 47, 42 rotate as a unit.

A turbine speed sensor 43 for detecting the rotational speed of the input shaft 42, i.e., the rotational speed of the turbine runner 47 (which will be called "turbine speed NT"), is provided in the vicinity of the input shaft 42. Also, the automatic transmission 44 is provided with a gear position sensor 45 for detecting a currently selected or established gear position of the transmission 44.

An output shaft 48 of the automatic transmission 44 is connected to driving wheels (not shown), via a differential gear unit (not shown) and a driveshaft (not shown). In this embodiment, the above-mentioned automatic transmission 44, differential gear unit, driveshaft, and other components constitute a driving system (or power train) of the vehicle.

The ECU (Electronic Control Unit) 40 serving as a control device is a logic circuit that includes a central processing unit (CPU), ROM that stores certain control programs and so forth, RAM that temporarily stores operation results of the CPU and so forth, backup RAM, and other components. The CPU, ROM, RAM and backup RAM are connected to each other and to external input circuits and external output circuits, through buses. The above-mentioned various sensors and actuators are electrically connected to the ECU 40.

In the present embodiment, the ECU 40 controls driving of the throttle valve motor 37, based on input values received from the respective sensors including the acceleration stroke sensor 39, engine speed sensor 20, turbine speed sensor 43 and the gear position sensor 45.

When the throttle valve motor 37 is driven, and the throttle opening changes, the amount of intake air drawn into the combustion chamber 16 changes with a little delay relative to the change in the throttle opening, due to a delay in transportation of air. Namely, the torque of the engine 11 and the engine speed NE change with a little delay relative to the change in the throttle opening.

Figure 7:
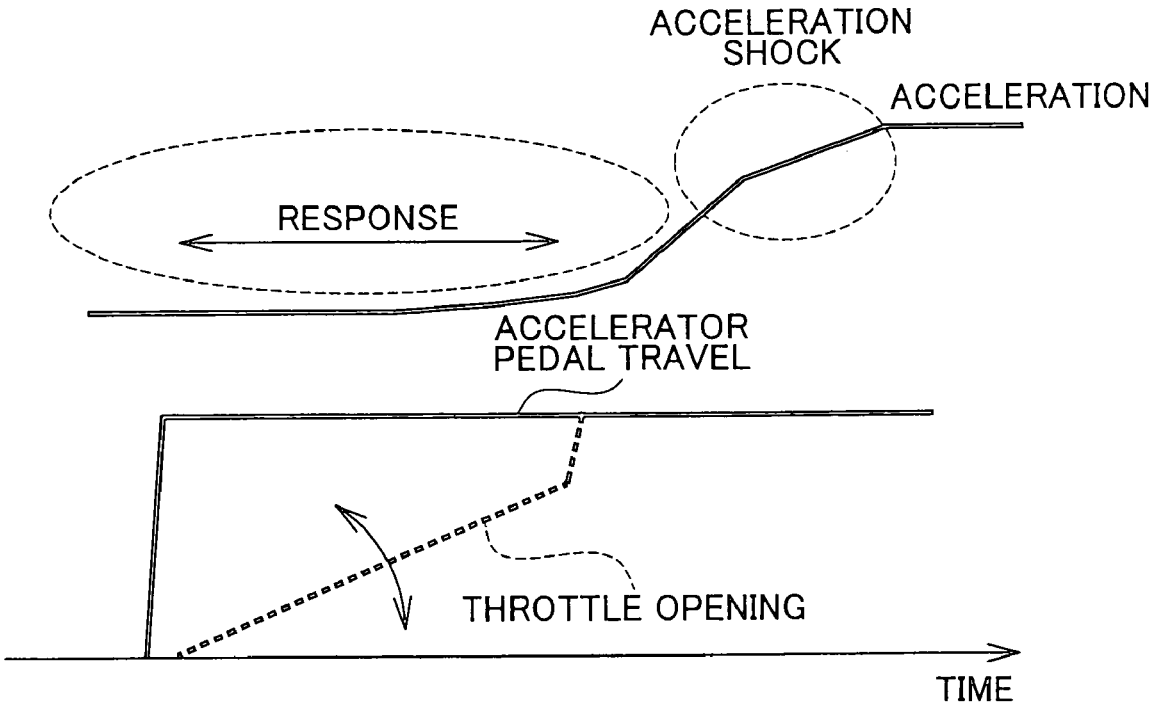
FIG. 7 RELATED ART
FIG. 7 is a timing chart showing throttle opening control of the related art.

FIG. 2A through FIG. 2D are timing charts useful for explaining throttle opening control of the first embodiment. FIG. 7 is a timing chart useful for explaining throttle opening control of the related art. Before the throttle opening control of the present embodiment is explained, the throttle opening control of the related art will be explained with reference to FIG. 7, so that the operation and effects of this embodiment can be easily and clearly understood.

As shown in FIG. 7, the throttle opening control of the related art is performed so as to gradually increase the throttle opening at a predetermined rate when the accelerator pedal is depressed while the vehicle is in a decelerating condition (with the accelerator pedal being released). In this case, as the rate of increase of the throttle opening decreases, acceleration shock can be reduced to a greater extent, whereas the time lag between the depression of the accelerator pedal and rising of the vehicle acceleration increases, namely, the response deteriorates. If the rate of increase of the throttle opening is increased, namely, the throttle opening is increased at a higher rate, the response is improved, but acceleration shock is more likely to occur. Thus, it is difficult for the throttle opening control of the related art to achieve both suppression of acceleration shock and quick response.

On the other hand, the throttle opening control of the present embodiment make it possible to provide quick response while effectively suppressing acceleration shock. Referring to FIG. 2A through FIG. 2D, the throttle opening control of this embodiment will be explained.

In FIGS. 2A-2D, the vehicle is in a decelerating condition (or engine-brake condition) in which the accelerator pedal is released, on and before time t1. In the decelerating condition, the engine speed NE is lower than the turbine speed NT. In FIGS. 2A-2D, the accelerator pedal 38 is depressed at time t1 from the decelerating condition as described above, and the accelerator operation amount starts increasing.

A target throttle opening as indicated by the dotted line in FIG. 2D is calculated on the basis of the accelerator operation amount. In the throttle opening control, the throttle opening is to be finally made equal to the target throttle opening. In this embodiment, while the throttle opening is increased from 0° to the target throttle opening, first throttle opening holding control (time t2 to t3) for temporarily holding the throttle opening constant is performed, and second throttle opening holding control (time t4 to t5) for temporarily holding the throttle opening constant again is performed after the first throttle opening holding control, as shown in FIG. 2D.

First Throttle Opening Holding Control

The first throttle opening holding control (time t2 to t3) is performed so as to suppress or reduce shock derived from play in the driving system. Since the engine speed NE is lower than the turbine speed NT during deceleration of the vehicle, as described above, play (or clearances) present in the driving system including the gearbox of the automatic transmission 44 and the differential gear unit has not been filled or taken up. As the engine speed NE increases from this condition, the play in the driving system is absorbed or removed at the moment when the engine speed NE exceeds the turbine speed NT. Upon completion of absorption (removal) of the play in the driving system (at time t3), the vehicle is brought into a driving condition in which the engine torque is transmitted to the driveshaft, and the driveshaft torque starts increasing from zero in the positive direction, as shown in FIG. 2A.

At the moment when the engine speed NE exceeds the turbine speed NT, play in the driving system is absorbed or removed, and shock (which will be called "driving-system play-derived shock" in this specification) occurs due to the removal of the play. In order to suppress the driving-system play-derived shock, the rate of increase of the engine speed at the moment when the engine speed NE exceeds the turbine speed NT may be reduced. To this end, the rate of increase of the throttle opening after depression of the accelerator pedal may be reduced so that the engine torque is prevented from rising too quickly.

If the rate of increase of the throttle opening is reduced, however, air is less likely to be introduced into the engine 11 even after the accelerator pedal is depressed, resulting in an increase of the time lag between depression of the accelerator pedal and development of the engine torque. Namely, the response deteriorates.

In the present embodiment, therefore, after rapidly increasing the throttle opening to a first specified opening TA1 in response to depression of the accelerator pedal, the ECU 40 performs control (time t2 to t3) for temporarily holding the throttle opening at TA1, as shown in FIG. 2D. In this specification, this control is called "first throttle opening holding control".

According to the control as described above, the throttle opening is rapidly increased to the first specified opening TA1 after depression of the accelerator pedal, so that a sufficient amount of air can be fed to the engine 11 in a short time. As a result, the time lag between depression of the accelerator pedal and the time when the engine develops torque (i.e., when the engine speed NE starts increasing) can be shortened, and quick response can be obtained.

At a point in time (time t2) at which the throttle opening has risen to the first specified opening TA1, the engine speed NE is still lower than the turbine speed NT. According to the first throttle opening holding control, the throttle opening is temporarily held at the first specified opening TA1 in the condition where NE is lower than NT, and, therefore, the rate of increase of the engine speed NE can be temporarily reduced. Namely, at the moment when the engine speed NE exceeds the turbine speed NT, namely, when play in the driving system is absorbed or removed, the rate of increase of the engine speed can be reduced. Accordingly, the above-mentioned driving-system play-derived shock can be effectively suppressed.

The first specified opening TA1 at which the throttle opening is held during the first throttle opening holding control is preferably set based on the gear position of the automatic transmission 44 and the engine speed NE. By setting the first specified opening TA1 based on the gear position and the engine speed NE, it is possible to set the opening TA1 to the optimum degree appropriate to the gear position and the engine speed NE, and thus achieve higher levels of suppression of the driving-system play-derived shock and quick response. In this case, the first specified throttle opening TA1 is preferably set to a road-load opening. The road-load opening is a steady-state throttle opening at which the driving force and running resistance are balanced with each other, and can be empirically or theoretically obtained in advance, in accordance with the gear position and the engine speed NE.

In the case where the first specified throttle opening TA1 is set based on the gear position and the engine speed NE, the ECU 40 stores in advance a map defining the relationship between the engine speed NE and the first specified opening TA1 for each gear position. In this case, the ECU 40 may set the first specified opening TA1 with reference to the map, on the basis of the gear position detected by the gear position sensor 45, and the engine speed NE detected by the engine speed sensor 20.

When the first throttle opening holding control is finished (at time t3), the ECU 40 starts increasing the throttle opening again, as shown in FIG. 2D, so as to raise the driveshaft torque and give a sense of acceleration to the vehicle driver or operator. In this case, the timing of finishing of the first throttle opening holding control is preferably controlled in the manner as described below.

Condition 1 for Finishing First Throttle Opening Holding Control

When the engine speed NE exceeds the turbine speed NT, it can be determined that absorption of play in the driving system is completed, namely, play in the driving system has been completely removed, as described above. If the throttle opening starts being increased again immediately after completion of absorption of play in the driving system, it is possible to provide quick response while suppressing the driving-system play-derived shock. Thus, the ECU 40 monitors a difference in the rotational speed between the engine speed NE and the turbine speed NT based on the detected values of the engine speed sensor 20 and turbine speed sensor 43, and finishes the first throttle opening holding control when the difference in the rotational speed becomes equal to zero.

Condition 2 for Finishing First Throttle Opening Holding Control

If the above-described condition 1 is employed, the time (time t3) at which the throttle opening starts being increased again is delayed in the case where it takes time for the engine speed NE to become higher than the turbine speed NT. In the present embodiment, therefore, a period of time during which the throttle opening is held at the first specified opening TA1 (which will be called "opening holding time") is set in advance for each gear position, and the ECU 40 finishes the first throttle opening holding control without waiting until the difference between the engine speed NE and the turbine speed NT becomes equal to zero, when an elapsed time from the point (time t2) of start of the first throttle opening holding control reaches the opening holding time. This arrangement can surely avoid a delay in the timing (time t3) at which the throttle opening starts being increased again, thus assuring a further improvement in the response. In this connection, the level of driving-system play-derived shock varies from one gear position to another. Accordingly, the opening holding time is preferably set in advance to a length large enough to sufficiently suppress the driving-system play-derived shock, with respect to each gear position. The condition 2 for finishing the first throttle opening holding control is applied, namely, the preset opening holding time expires before the difference between the engine speed NE and the turbine speed NT becomes equal to zero, in the case where the engine speed NE increases at a relatively low rate. In this case, large driving-system play-derived shock does not occur even if the ECU 40 finishes the first throttle opening holding control without waiting until the difference between the engine speed NE and the turbine speed NT becomes equal to zero.

In the present embodiment, the above-described finishing conditions 1 and 2 are both employed, and the first throttle opening holding control is finished under one of the two conditions which is satisfied earlier. With this arrangement, suppression of driving-system play-derived shock and quick response can be both achieved with higher reliability. It is, however, to be understood that the invention is not limited to the above-described control concerning finishing of the first throttle opening holding-control. For example, the first throttle opening holding control may be finished using only one of the above-described finishing conditions 1 and 2.

Once the first throttle opening holding control is finished (at time t3), the ECU 40 starts increasing the throttle opening again, as shown in FIG. 2D. As a result, the engine torque increases, and the driveshaft torque starts increasing with increase in the engine torque. Thus, the rate of increase of the throttle opening after the first throttle opening holding control is finished greatly influences a sense of acceleration felt by the driver. In the present embodiment, therefore, it is desirable to set the rate of increase of the throttle opening after finishing of the first throttle opening holding control, for each of the gear positions, so that the vehicle acceleration varies (increases) at a rate appropriate to each of the gear positions. More specifically, the amount of throttle opening added (i.e., the increment of the throttle opening) for each computing cycle of the ECU 40 may be set in advance for each of the gear positions, so that the rate of increase of the throttle opening can be controlled for each gear position. The rate of increase of the throttle opening after finishing of the first throttle opening holding control may also be set in accordance with the engine speed NE as well as the established gear position.

Acceleration Shock due to Sway-back of Power Train

Figure 3:
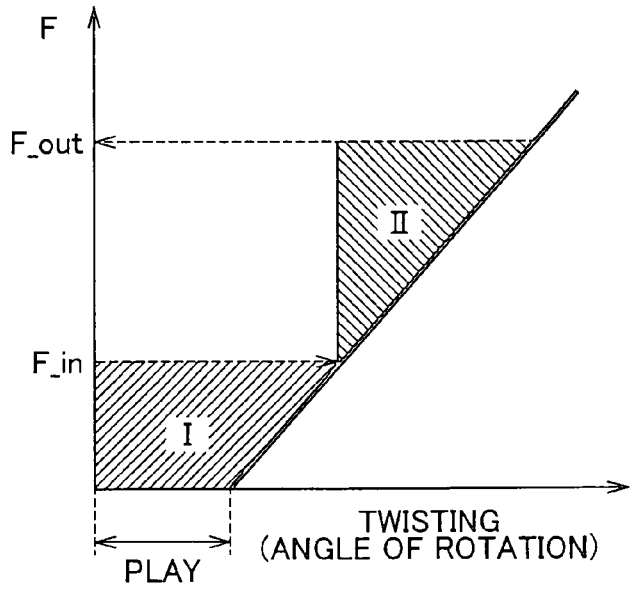
FIG. 3 is a graph indicating the relationship between play in a driving system and impact force.

When absorption or removal of play in the driving system is completed, and engine torque (positive torque) starts being transmitted to the driving system, the driving system (in particular, the driveshaft) is brought into a twisted condition. Reaction force generated from the driving system when it is restored from the twisted condition causes sway-back of the driving system. FIG. 3 is a graph indicating the relationship between play in the driving system and impact force. If positive torque is applied to the driving system to cause twisting of the system, as indicated by area I in FIG. 3, the driving system sways back with the same force as the torsional force, as indicated by II in FIG. 3. When the vehicle is accelerated from the decelerating condition, acceleration-shock due to sway-back of the driving system transmitted to the vehicle occurs in addition to the driving-system play-derived shock as described above.

Second Throttle Opening Holding Control

The second throttle opening holding control (time t4 to t5 in FIG. 2D) is performed so as to suppress acceleration shock due to sway-back of the driving system as described above. Initially, the case where this control is not performed will be explained so that the operation and effects of the second throttle opening holding control can be easily and clearly understood.

Dotted lines in FIG. 2A and FIG. 2B represent driveshaft torque and engine speed NE, respectively, in the case (comparative example) where the second throttle opening holding control is not performed. In the comparative example, the driveshaft torque undergoes periodic variations caused by sway-back of the driving system, as shown in FIG. 2A. The torque vibrations are transmitted to the vehicle, to produce acceleration shock.

In the present embodiment, on the other hand, during a process of increasing the throttle opening after the engine speed NE exceeds the turbine speed NT, control (time t4 to t5) for temporarily holding the throttle opening at a second specified opening TA2 is performed. This control is the second throttle opening holding control. By temporarily holding the throttle opening at the second specified opening TA2, it is possible to temporarily suppress increase of the engine torque. As a result, the height of the first crest (peak value) of the driveshaft torque variations caused by sway-back of the driving system can be suppressed or reduced to a relatively low level, as shown in FIG. 2A.

After the second throttle opening holding control is finished, the throttle opening starts being increased again (time t5 to t6). Since the engine torque increases with an increase in the throttle opening between time t5 and time t6, the driveshaft torque is prevented from dropping at the first trough of the driveshaft torque variations caused by sway-back of the driving system as in the comparative example, as shown in FIG. 2A.

According to the second throttle opening holding control as described above, the engine torque can be controlled to vary in opposite phase to the driveshaft torque variations due to sway-back of the driving system, so as to counteract the driveshaft torque variations, as shown in FIG. 2A. In this manner, the driveshaft torque variations can be reduced. Consequently, acceleration shock due to sway-back of the driving system can be effectively suppressed. As the driveshaft torque variations decrease, variations in the engine speed NE can also be reduced, as shown in FIG. 2B.

Since the second throttle opening holding control provides the above-described effect of counteracting the driveshaft torque variations, sway-back of the driving system can be extremely effectively suppressed. In the present embodiment, therefore, acceleration shock can be sufficiently suppressed even if the throttle opening is increased at a relatively high rate before and after the second throttle opening holding control. It is thus possible to increase the throttle opening to the final target opening in a short time, assuring quick response, while suppressing sway-back of the driving system.

The second specified throttle opening TA2 at which the throttle opening is held under the second throttle opening holding control is preferably set based on the established gear position of the automatic transmission 44 and the engine speed NE. In this manner, the second specified opening TA2 can be set to an optimum degree for varying the engine torque in opposite phase to the driveshaft torque variations, in accordance with the currently established gear position and the engine speed NE. It is thus possible to achieve higher levels of suppression of sway-back of the driving system and quick response.

When the second specified throttle opening TA2 is set based on the established gear position and the engine speed NE, the ECU 40 stores in advance a map defining the relationship between the engine speed NE and the second specified opening TA2 with respect to each of the gear positions. Referring to this map, the ECU 40 may set the second specified opening TA2 based on the currently established gear position and the engine speed NE.

The timing (time t5) of finishing of the second throttle opening holding control is preferably controlled in the following manner. In the first place, it is preferable to finish the second throttle opening holding control before the time (t6) at which the first crest (peak value) appears in the driveshaft torque variations caused by sway-back of the driving system. In this manner, the timing of increase of the engine torque due to the increase (time t5 to t6) in the throttle opening after finishing of the second throttle opening holding control can be surely matched with the timing of appearance of the first trough of the driveshaft torque variations due to sway-back of the driving system. It is thus possible to suppress or prevent dropping of the driveshaft torque at the first trough of the driveshaft torque variations with higher reliability, and reduce acceleration shock due to sway-back of the driving system to a smaller level.

In the meantime, the period T (FIG. 2A) of the driveshaft torque variations due to sway-back of the driving system is expressed by $T=1/f$, where f indicates resonance frequency of torsional vibration of the driving system. The torsional resonance frequency f of the driving system tends to be higher as the automatic transmission 44 is in a higher-speed gear position (having a smaller speed ratio). Namely, the higher-speed gear position the automatic transmission 44 is in, the shorter the period T of the driveshaft torque variations is. Thus, it is preferable to make the timing of finishing of the second throttle opening holding control earlier as the automatic transmission 44 is in a higher-speed gear position. In other words, it is preferable to make the timing of finishing of the second throttle opening holding control earlier as the resonance frequency of torsional vibration of the driving system is higher.

In the present embodiment, therefore, the ECU 40 preferably sets in advance the opening holding time for the second throttle opening holding control with respect to each of the gear positions, so that the opening holding time becomes shorter as the automatic transmission 44 is in a higher-speed gear position, and finishes the second throttle opening holding control when the elapsed time from the time (t4) of start of the second throttle opening holding control reaches the preset opening holding time. Thus, acceleration shock due to sway-back of the driving system can be more effectively suppressed.

In the present embodiment, it is also preferable to set the rate of increase of the throttle opening after finishing of the second throttle opening holding control, based on the established gear position of the automatic transmission 44. In this manner, the rate of increase of the throttle opening can be set to an optimum value for suppressing driveshaft torque variations due to sway-back of the driving system, depending upon the currently established gear position. Thus, the control system of this embodiment achieves higher levels of suppression of sway-back of the driving system and quick response. More specifically, the amount of throttle opening added (i.e., the increment of the throttle opening) for each computing cycle of the ECU 40 may be set in advance for each of the gear positions, so that the rate of increase of the throttle opening can be controlled for each gear position. The rate of increase of the throttle opening after finishing of the second throttle opening holding control may also be set in accordance with the engine speed NE as well as the established gear position.

The second throttle opening holding control may be started when the relationship between the engine speed NE and the turbine speed NT is switched or reversed, namely, when the engine speed NE exceeds the turbine speed NT.

Correction based on Accelerator Operation Amount

Figure 4:
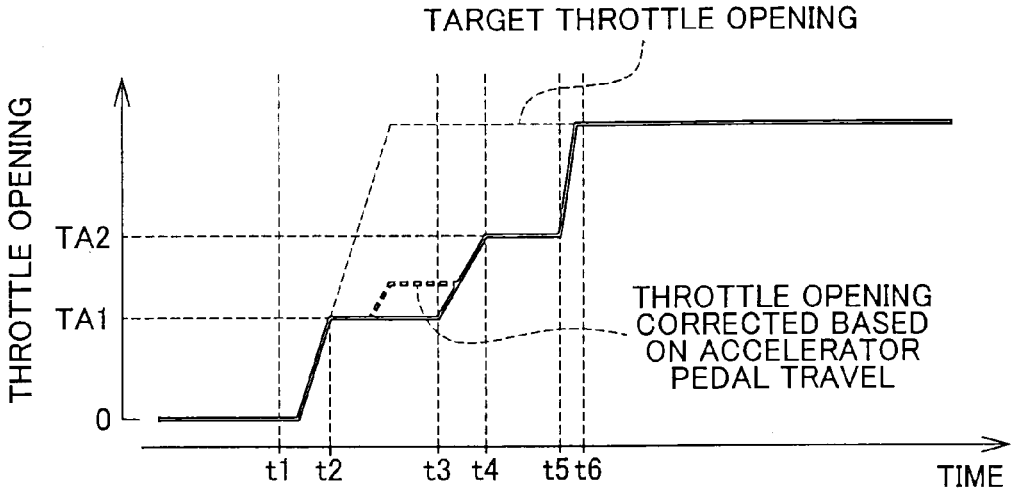
FIG. 4 is a graph showing changes in the throttle opening with time when the throttle opening is corrected based on the accelerator operation amount.

While the throttle opening control of the present embodiment has been explained above, the throttle opening set in the manner as described above may be corrected in accordance with the amount of depression of the accelerator pedal 38. This correction will be called "correction based on the accelerator operation amount". FIG. 4 shows changes in the throttle opening when the correction based on the accelerator operation amount is performed. A thick, broken line in FIG. 4 indicates throttle opening corrected based on the accelerator operation amount.

To achieve high levels of suppression of acceleration shock and quick response, it is desirable to set the throttle opening in the manner as described above. However, the driver's demand is not always the same. More specifically, when the amount of depression of the accelerator pedal 38 is large, the driver is given a higher level of satisfaction if he/she feels a sense of acceleration more quickly even in the presence of some degree of acceleration shock. Conversely, when the amount of depression of the accelerator pedal 38 is small, the driver's demand is more likely to be met if acceleration shock is suppressed or reduced to a smaller level even with some delay in the response. Therefore, in the case where the amount of depression of the accelerator pedal 38 is large, the correction of the throttle opening based on the accelerator operation amount is performed with greater emphasis placed on the response rather than suppression of acceleration shock, by increasing the throttle opening or reducing the length of the opening holding time TA1, TA2. In the case where the amount of depression of the accelerator pedal 38 is small, on the other hand, the correction is performed with greater emphasis placed on suppression of acceleration shock rather than the response, by reducing the throttle opening or increasing the length of the opening holding time TA1, TA2.

More specifically, the correction as described above may be performed by preparing a correction coefficient that increases with increase in a difference between the target throttle opening and the actual throttle opening, and multiplying the throttle opening by the correction coefficient. FIG. 4 shows an example in which the throttle opening is multiplied by a correction coefficient larger than 1 and is thus increased during the first throttle opening holding control.

The correction based on the accelerator operation amount may be performed with respect to not only the throttle opening during the first throttle opening holding control, but also the throttle opening holding time in the first throttle opening holding control, the rate of increase of the throttle opening between the first throttle opening holding control and the second throttle opening holding control, the throttle opening TA2 during the second throttle opening holding control, the rate of increase of the throttle opening after finishing of the second throttle opening holding control, and so forth.

Modified Examples

Figure 5:
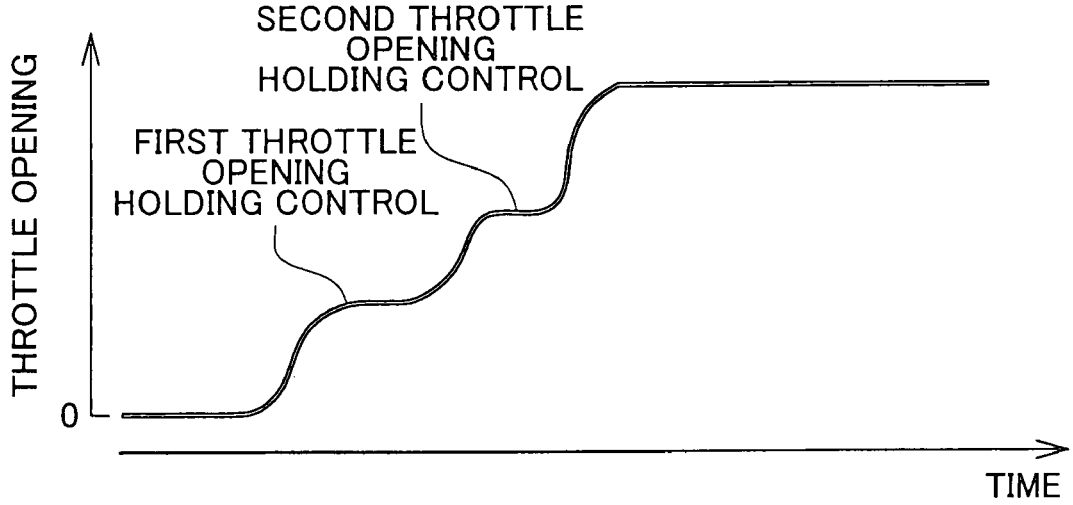
FIG. 5 is a timing chart showing throttle opening control of a first modified example.

Next, modified examples of the illustrated embodiment will be explained. The illustrated embodiment may be modified as shown in, for example, FIG. 5 or FIG. 6. In throttle opening control of a first modified example as shown in FIG. 5, the throttle opening changes with time along smooth curves, rather than straight lines as shown in FIG. 2D in connection with the illustrated embodiment. Thus, the throttle opening control of the invention may be performed by changing the throttle opening in curves. According to the present invention, the throttle opening established during the first throttle opening holding control or the second throttle opening holding control is not necessarily held fully constant, but may be held substantially constant.

Figure 6:
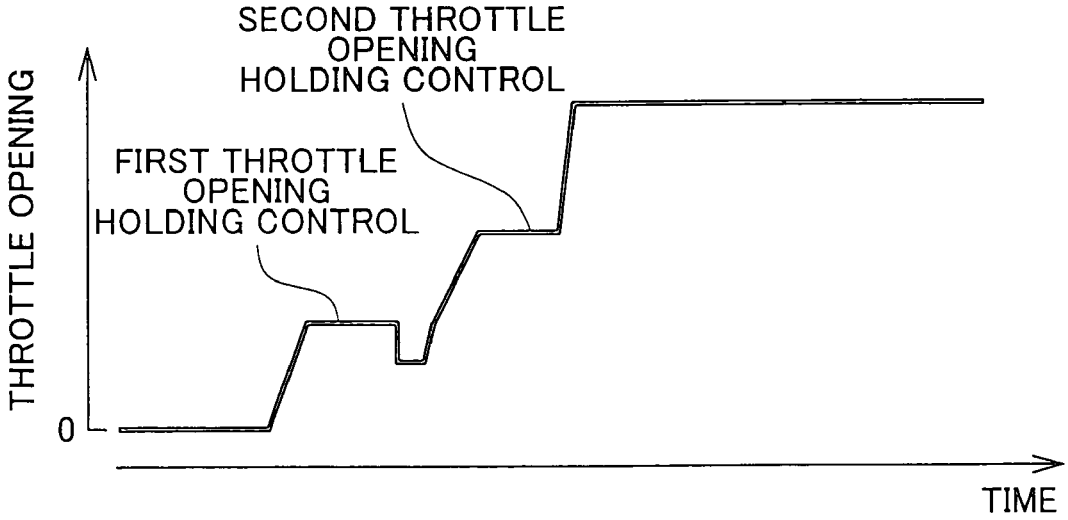
FIG. 6 is a timing chart showing throttle opening control of a second modified example.

In throttle opening control of a second modified example as shown in FIG. 6, after the throttle opening is held constant under the first throttle opening holding control, the throttle opening is temporarily reduced. Thus, the throttle opening control of the invention may allow the throttle opening to be reduced once or more for a certain period(s) during a process of increasing the throttle opening to the target opening.

While the control of the illustrated embodiment is performed on the system including a multiple-speed transmission having a plurality of gear positions, the invention may also be applied to control performed on a system including a continuously variable transmission. In this case, where the throttle opening is controlled in accordance with the established gear position in the illustrated embodiment, the throttle opening may be controlled in accordance with the speed ratio of the continuously variable transmission, in place of the gear position.

In the first embodiment as described above, the turbine speed NT may be regarded as "input shaft speed of the driving system".

In the system of the first embodiment as described above, the amount of intake air supplied to the engine 11 is controlled by means of the throttle valve 36. However, if the engine 11 is equipped with a variable valve actuating mechanism capable of continuously varying the operation angle and/or lift of each intake valve 24, it is possible to change the amount of intake air supplied to the engine 11 by changing the operation angle and/or lift of the intake valve 24. In this case, the operation angle and lift of the intake valve 24 correspond with the throttle opening. In this specification, the term "throttle opening" implies or includes the operation angle and lift of the intake valve 24 in this case. Namely, the invention may be applied to a control system for controlling the operation angle and/or lift of each intake valve 24 in a system that controls the intake air amount by continuously changing the operation angle and/or lift of the intake valve 24.

While the invention has been described with reference to what are considered to be preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single element, are also within the spirit and scope of the invention.

What is claimed is:

1. A throttle opening control system for an internal combustion engine that is installed on a vehicle and drives the vehicle via a driving system, comprising:

a first throttle opening holding device that performs first throttle opening holding control for temporarily holding a throttle opening substantially constant during a process of increasing the throttle opening when an accelerator pedal is depressed while the vehicle is in a decelerating condition; and a second throttle opening holding device that performs second throttle opening holding control for temporarily holding the throttle opening substantially constant again during the process of increasing the throttle opening, after the first throttle opening holding control is finished, wherein the first throttle opening holding device and the second throttle opening holding device perform the respective temporary holdings prior to the throttle opening reaching a target throttle opening.

2. A throttle opening control system for an internal combustion engine according to claim 1, wherein:

the first throttle opening holding control is started while an engine speed is lower than an input shaft speed of the driving system; and the second throttle opening holding control is started after the engine speed becomes equal to or higher than the input shaft speed.

3. A throttle opening control system for an internal combustion engine according to claim 1, further comprising:

a holding time control device that sets a throttle opening holding time for which the throttle opening is held substantially constant under the second throttle opening holding control, in accordance with a resonance frequency of torsional vibration of the driving system.

4. A throttle opening control system for an internal combustion engine according to claim 1, wherein the driving system includes a transmission having a plurality of gear positions or speed ratios, further comprising:

a holding time control device that sets a throttle opening holding time for which the throttle opening is held substantially constant under the second throttle opening holding control, such that the throttle opening holding time becomes shorter as the transmission is in a higher-speed gear position or speed ratio.

5. A throttle opening control system for an internal combustion engine according to claim 1, wherein the second throttle opening holding control is finished before appearance of the first peak value of driveshaft torque variations caused by sway-back of the driving system.

6. A throttle opening control system for an internal combustion engine according to claim 1, wherein the driving system includes a transmission having a plurality of gear positions or speed ratios, further comprising:

a specified opening setting device that sets a specified throttle opening at which the throttle opening is substantially held under the second throttle opening holding control, based on an established gear position or speed ratio of the transmission and an engine speed.

7. A throttle opening control system for an internal combustion engine according to claim 1, wherein the driving system includes a transmission having a plurality of gear positions or speed ratios, further comprising:

an opening rate-of-increase setting device that sets a rate of increase of the throttle opening after finishing of the second throttle opening holding control, based on an established gear position or speed ratio of the transmission.

8. A throttle opening control system for an internal combustion engine according to claim 1, wherein the driving system includes a transmission having a plurality of gear positions or speed ratios, further comprising:

a device that sets at least one of a specified throttle opening at which the throttle opening is substantially held under the first throttle opening holding control, a throttle opening holding time for which the throttle opening is held substantially constant under the first throttle opening holding control, and a rate of increase of the throttle opening during a period between the first throttle opening holding control and the second throttle opening holding control, based on at least one of an established gear position or speed ratio of the transmission and an engine speed.

9. A throttle opening control system for an internal combustion engine according to claim 1, wherein the driving system includes a transmission having a plurality of gear positions or speed ratios, further comprising:

a rotational-speed difference detecting device that detects a rotational-speed difference between an engine speed and an input shaft speed of the driving system; and a holding time setting device that sets a throttle opening holding time for which the throttle opening is held substantially constant under the first throttle opening holding control, based on an established gear position or speed ratio of the transmission, wherein:

the first throttle opening holding control is finished under an earlier satisfied one of a first condition that the rotational-speed difference becomes equal to zero and a second condition that the throttle opening holding time set by the holding time setting device expires.

10. A throttle opening control system for an internal combustion engine according to claim 1, further comprising:

a correcting device that corrects at least one of a first specified throttle opening at which the throttle opening is substantially held under the first throttle opening holding control, a throttle opening holding time for which the throttle opening is held substantially constant under the first throttle opening holding control, a rate of increase of the throttle opening during a period between the first throttle opening holding control and the second throttle opening holding control, a second specified throttle opening at which the throttle opening is substantially held under the second throttle opening holding control, and a rate of increase of the throttle opening after finishing of the second throttle opening holding control, based on an accelerator operation amount.

11. A throttle opening control system for an internal combustion engine according to claim 1, further comprising:

a throttle opening reducing device that temporarily reduces the throttle opening after finishing of the first throttle opening holding control.

12. A method of controlling a throttle opening of an internal combustion engine that is installed on a vehicle and drives the vehicle via a driving system, comprising:

a first step of temporarily holding the throttle opening substantially constant during a process of increasing the throttle opening when an accelerator pedal is depressed while the vehicle is in a decelerating condition; and a second step of temporarily holding the throttle opening substantially constant again during the process of increasing the throttle opening, after the first step is finished, wherein the first step and the second step of temporarily holding the throttle opening are performed prior to the throttle opening reaching a target throttle opening.

* * * * *